US006726878B1

(12) United States Patent
Flidlyander et al.

(10) Patent No.: US 6,726,878 B1
(45) Date of Patent: Apr. 27, 2004

(54) HIGH STRENGTH ALUMINUM BASED ALLOY AND THE ARTICLE MADE THEREOF

(75) Inventors: Iosif Naumovich Flidlyander, Moscow (RU); Evgeny Nikolaevich Kablov, Moscow (RU); Evgeniya Anatolievna Tkachenko, Moscow (RU); Vladimir Nikolaevich Samonin, Samara (RU); Viktor Yakovlevich Valkov, Samara (RU)

(73) Assignees: Federalnoe Gosudarstvennoe Unitarnoe Predpriyatie "Vserossiisky Nauchno-Issle-Dovatelsky Institut Aviatsionnykh Materialov", Moscow (RU); Otkrytoe Aktsionernoe Obschestvo "Samarsky Metallurgichesky Zavod", Samara (RU)

( * ) Notice: Subject to any disclaimer, the term of this patent is extended or adjusted under 35 U.S.C. 154(b) by 0 days.

(21) Appl. No.: 10/089,702

(22) PCT Filed: Sep. 28, 2000

(86) PCT No.: PCT/RU00/00386

§ 371 (c)(1),
(2), (4) Date: May 22, 2002

(87) PCT Pub. No.: WO01/25498

PCT Pub. Date: Apr. 12, 2001

(30) Foreign Application Priority Data

Oct. 5, 1999 (RU) ..... 99120975

(51) Int. Cl.[7] ..... C22C 21/00
(52) U.S. Cl. ..... 420/532; 420/535; 148/417
(58) Field of Search ..... 148/417; 420/535, 420/532

(56) References Cited

U.S. PATENT DOCUMENTS

| | | | | |
|---|---|---|---|---|
| 4,711,762 A | * | 12/1987 | Vernam et al. | 420/532 |
| 4,828,631 A | | 5/1989 | Ponchel et al. | 148/417 |
| 4,832,758 A | | 5/1989 | Brown | 148/12.7 |
| 5,047,092 A | | 9/1991 | Faure | 148/11.5 |
| 6,027,582 A | * | 2/2000 | Shahani et al. | 148/417 |

FOREIGN PATENT DOCUMENTS

| | | |
|---|---|---|
| EP | 0391815 | 10/1990 |
| EP | 0829552 | 3/1998 |
| FR | 2744136 | 8/1997 |
| GB | 604813 | 7/1948 |
| SU | 436876 | 7/1974 |
| WO | 9727343 | 7/1997 |

OTHER PUBLICATIONS

English translation of the Abstract of EP 0391815 Dated Oct. 10, 1990.

English translation of the abstract of FR 2744136 dated Aug. 1, 1997.

Industrial Aluminum Alloys, Ed. F.I. Kvasov, et al. "Metallurgia", (1984).

* cited by examiner

*Primary Examiner*—George Wyszomierski
*Assistant Examiner*—Janell Combs Morillo
(74) *Attorney, Agent, or Firm*—Ladas & Parry

(57) ABSTRACT

The invention relates to high strength aluminium—based alloy of Al—Zn—Mg—Cu system and the articles made thereof. The present alloy is characterized by the combination of improved properties: flowability, technological plasticity, fracture toughness while preserving high levels of strength properties.

Said alloy comprises (mass. %):

| | | | |
|---|---|---|---|
| Zn | 6.35–8.0 | Si | 0.01–0.2 |
| Mg | 0.5–2.5 | Fe | 0.06–0.25 |
| Cu | 0.8–1.3 | Zr | 0.07–0.2 |
| Cr | 0.001–0.05 | Ti | 0.03–0.1 |
| Mn | 0.001–0.1 | Be | 0.0001–0.05 |

and at least one element from the group of alkali-earth metals:

| | |
|---|---|
| K | 0.0001–0.01 |
| Na | 0.0001–0.01 |
| Ca | 0.0001–0.01 |
| Al-balance | |

the sum $Zr+2Ti \leqq 0.3\%$, and the ratio $Si:Be \geqq 2$.

The invented alloy is suitable for producing large-sized, extruded, rolled and forged semiproduct articles used for manufacture of loaded members of aircraft, cars and other machinery.

14 Claims, No Drawings

HIGH STRENGTH ALUMINUM BASED ALLOY AND THE ARTICLE MADE THEREOF

FIELD OF THE INVENTION

This invention relates to non-ferrous metallurgy, and in particular it relates to high strength aluminium based alloys of Al—Zn—Mg—Cu system. The invented alloy is suitable for producing extruded, rolled and forged semiproducts (mainly articles having large sections) used for manufacture loaded members of aircraft, lorries and cars, seagoing and river vessels, agricultural machinery.

BACKGROUND OF THE INVENTION

Al—Zn—Mg—Cu alloys are widely used in the aircraft and aerospace industries. Well-known is the Russian alloy of said system comprising (mass. %):

| | |
|---|---|
| Zn 6.5–7.3 | Fe 0.2–0.4 |
| Mg 1.6–2.2 | Si < 0.2 |
| Cu 0.8–1.2 | Al-balance |

Said alloy doesn't provide high (UTS,YTS) properties and fracture toughness ($K_{1c}$). The articles made from said alloy have limited efficiency in weight and unsatisfactory service life (Handbook, Aluminium alloys, 1984, Moscow, publ. "Metallurgy".

The American alloys of Al—Zn—Mg—Cu system (7000 series) developed by ALCOA are also well-known. For instance, the alloy described in U.S. Pat. No. 4,828,631 comprises (in mass. %):

| | |
|---|---|
| Zn 5.9–8.2 | Ti < 0.06 |
| Mg 1.5–4.0 | Si < 0.12 |
| Cu 1.5–3.0 | Fe < 0.15 |
| Zr 0.08–0.15 | impurities < 0.05 each and < 0.15 in total |
| B < 0.01 | Al-balance |
| Cr < 0.4 | |

This alloy has been developed for particular use in aircraft and aerospace articles. It has superior exfoliation corrosion resistance, but its hardenability is sacrificed. In case the semiproduct has the thickness of more than 100 mm, the service characteristics (fracture toughness, strength, plasticity, corrosion resistance and uniformity of properties in semiproducts' volume) become worse. All these shortcomings do not allow to produce large—sized articles from said alloy.

The alloy described in U.S. Pat. No. 4,832,758 comprises (in mass. %):

| |
|---|
| Zn 4.0–8.0 |
| Mg 1.5–3.0 |
| Cu 1.0–2.5 |

at least one element from the group:

| |
|---|
| Cr 0.05–0.3 |
| Mn 0.1–0.5 |
| Zr 0.05–0.3 |
| Al-balance |

This alloy is intended to be used for producing semiproducts (plates) of the limited thickness (not more than 64 mm) because when increasing the thickness of a semiproduct, its mechanical properties, fracture toughness and corrosion resistance are essentially reduced.

The alloy desclosed in EP 0829552 comprises (in mass. %):

| | |
|---|---|
| Zn 5.2–6.8 | Si ≦ 0.06 |
| Mg 1.6–2.1 | Fe ≦ 0.06 |
| Cu 1.75–2.4 | Fe + Si ≦ 0.11 |
| Zr 0.08–0.15 | Al-balance |

This alloy may be used for manufacture of wing members of jet aircraft, mainly spars, lower skins, etc. The disadvantage of this alloy is its' high sensibility to quenching rate which leads to sharp reducing the strength and fracture toughness in case the semiproduct has the thickness more than 60 mm. Therefore when irregular-shaped members (fittings, landing gear elements, etc) are to be manufactured from said alloy, the great difficulties arise in the process of mechanical working.

Pechiney of France also has claimed several alloys of Al—Zn—Mg—Cu system. The alloy described in EP 0391815 comprises (in mass. %):

| | |
|---|---|
| Zn 5.5–8.45 | Si ≦ 0.5 |
| Mg 2.0–3.5 | Fe ≦ 0.5 |
| Cu 0.5–2.5 | other elements 0.05 each but not more |
| Cr 0.3–0.6 | than 0.15 in total amount |
| Mn 0.3–1.1 | Al-balance |

This alloy is intended to be used for producing small-sized semiproducts (sheets, plates, extruded articles) prepared by powder metallurgy method.

The disadvantage of such products is the low level of fracture toughness ($K_{1c}$) and low technological properties.

The high strength Al alloy described in PCT/FR 97/00144 comprises (in mass. %):

| | |
|---|---|
| Zn 5.9–8.7 | Si < 0.11 |
| Mg 1.7–2.5 | Fe < 0.14 |
| Cu 1.4–2.2 | Zr 0.05–0.15 |
| Cr < 0.02 | Mg + Cu < 4.1 |
| Mn < 0.02 | Al-balance |

The technological properties (flowability, technological plasticity) of this alloy are insufficient, and besides it has a reduced level of fracture toughness ($K_{1c}$).

The articles made from this alloy (i.e. fittings, frames) have non-uniform strength properties and fracture toughness upon thickness particularly in case of large sections.

DESCRIPTION OF THE INVENTION

The object of the present invention is to provide aluminium-based alloy of Al—Zn—Mg—Cu system having the improved combination of properties such as flowability, technological plasticity, increased fracture toughness, and also ensuring the uniformity of mechanical properties and fracture toughness upon product's thickness while preserving high levels of strength properties, and to provide the articles made from said alloy with said properties.

Accordingly, there is provided Al—Zn—Mg—Cu alloy comprising (in mass. %):

| | | | |
|---|---|---|---|
| Zn | 6.35–8.0 | Si | 0.01–0.2 |
| Mg | 0.5–2.5 | Fe | 0.06–0.25 |
| Cu | 0.8–1.3 | Zr | 0.07–0.2 |
| Cr | 0.001–0.05 | Ti | 0.03–0.1 |
| Mn | 0.001–0.1 | Be | 0.0001–0.05 |

at least one element from the group consisting of alkali-earth metals:

| | |
|---|---|
| K | 0.0001–0.01 |
| Na | 0.0001–0.01 |
| Ca | 0.0001–0.01 |
| Al-balance | |

$Zr+2Ti \leqq 0.3$ and $Si:Be \geqq 2$ and the article made thereof.

Alloying of the claimed alloy with additional elements—Be and at least one element from the group consisting of alkali-earth metals—K, Na, Ca, leads to increase in melt flowability upon casting due to their interaction with blisters and hydrogen being present in the metal, which in turn allows to perform melt filtration and degassing more effectively, that means to increase its purity and, as a result, to improve the technological plasticity of ingots.

The optimum ratio of Zr and Ti combined with lower amount of Cu and in presence of at least one of the alkali-earth metals—K, Na, Ca, provide improved level of fracture toughness while preserving high level of strength properties due to the reduction of volume content of primary phases and their refining, and also provide great uniformity of mechanical properties and fracture toughness upon product's thickness owing to more uniform distribution of secondary phases' particles in micrograin's volume, which ensures better hardenability of the present alloy.

Embodiments of the present invention will now be described by way of example.

EXAMPLE

For the purpose of the experiments, the ingots were cast from the alloys, the compositions of which are given in Table 1.

The alloys 2–9 are embodiments of the present invention (the present alloys or the claimed alloys), and the alloy 1—invention of PCT/FR 97/00144.

The hand forgings of, 60, 100, 150, 200 mm thickness (t) were made from homogenized ingots by the method of upsetting on a vertical press and the strips of 50 and 130 mm thickness (t) were made by extrusion on a horizontal press.

Semiproducts were heat treated as follows: solution heat treatment at temperature of 470° C., time (depending upon semiproduct's thickness) varied from 1 to 3 hours; and water-quenching; two step aging: at temperature 115° C. for 6 hours and at 170° C. for 10 hours.

The alloys flowability was estimated by conventional method by the length of a straight rod cast into a metallic mold. The technological plasticity was estimated by two methods: by upsetting the cylindrical samples on a press until a side crack appeared, and by tensile testing the conventional cylindrical samples.

The strength properties and fracture toughness of the alloys were estimated on conventional samples cut from different zones upon the thickness (t) of the semiproducts (¼ t and ½ t) in longitudinal (L or L-T) and short transverse (S or S-L) directions relative to fiber direction.

Table 2 shows the results of testing for technological properties' estimation of the alloys of the present invention and the prior art.

The results given in this Table evidently show that the present alloy (compositions 2–9) 1.2–1.4 times exceeds the known alloy in flowability and technological plasticity.

Table 3 shows the properties of a central zone of the forgings with 150 mm thickness made of the present alloy and the known alloy. One can evidently see from Table 3, that the present alloy 1.4–1.7 times exceeds the known alloy in fracture toughness in L-T direction, and 1.2–1.4 times—in S-T direction while the strength properties of both alloys are nearly the same. The best values of fracture toughness were defined on the alloys 3–5, 7, 9 which had ratios $Ti+2Zr \leqq 0.3$ and $Si:Be \geqq 2$.

Table 4 shows the mechanical properties of semiproducts with different thicknesses made of the present alloy and of the prior art alloy. The data of Table 4 shows that the present alloy as compared with the known alloy, provides more uniform mechanical properties and fracture toughness upon semiproduct' thickness what can especially be seen on large section samples with thickness of ≧150 mm; said samples show 1.5–2 times less reduction of strength properties and fracture toughness as compared with the known alloy.

The present alloy having improved flowability, technological plasticity, fracture toughness, and also more uniform strength properties and fracture toughness upon thickness, allows to produce wide range of semiproducts (forged, extruded and rolled) practically of any shape and dimensions, especially of large section.

The large-sized integral articles having uniform properties made of the present alloy will allow to increase by 10–20% the weight efficiency of the structure due to reduction of riveted joint' number and will ensure 15–20% increase of service reliability owing to improved fracture toughness.

The improvement of technological properties of the present alloy will ensure reduction of faulty production from said alloy, and use of large-sized semiproducts in aircraft structure will reduce labour intensity of assembling and will make the aircraft more economical by 30–40%.

Producing and use of the present alloy and articles thereof do not deteriorate environment from the ecological point of view.

TABLE 1

Compositions of experimental alloys

| No n/n | Alloy | Compositions, mass. % Zn | Mg | Cu | Fe | Si | Zr | Mn | Cr | Ti | Be | K | Na | Ca | Al |
|---|---|---|---|---|---|---|---|---|---|---|---|---|---|---|---|
| 1 | Prior Art | 6.7 | 2.0 | 1.4 | 0.1 | 0.05 | 0.11 | 0.02 | 0.02 | — | — | — | — | — | balance |
| 2 | Invention | 8.0 | 2.5 | 1.3 | 0.25 | 0.2 | 0.2 | 0.1 | 0.05 | 0.1 | 0.05 | 0.01 | 0.01 | 0.01 | balance |
| 3 | | 7.0 | 2.0 | 1.1 | 0.13 | 0.1 | 0.13 | 0.05 | 0.03 | 0.06 | 0.025 | 0.005 | 0.005 | 0.005 | balance |
| 4 | | 6.35 | 0.5 | 0.8 | 0.06 | 0.01 | 0.07 | 0.001 | 0.001 | 0.03 | 0.0001 | 0.0001 | 0.0001 | 0.0001 | balance |
| 5 | | 6.75 | 1.9 | 1.2 | 0.12 | 0.06 | 0.13 | 0.02 | 0.02 | 0.07 | 0.03 | — | — | 0.008 | balance |
| 6 | | 6.8 | 2.0 | 1.0 | 0.14 | 0.03 | 0.12 | 0.04 | 0.03 | 0.07 | 0.03 | — | 0.01 | — | balance |
| 7 | | 6.9 | 1.9 | 1.1 | 0.07 | 0.06 | 0.1 | 0.005 | 0.04 | 0.04 | 0.003 | 0.003 | — | — | balance |
| 8 | | 7.0 | 2.0 | 1.1 | 0.13 | 0.03 | 0.13 | 0.05 | 0.02 | 0.05 | 0.042 | 0.005 | — | 0.01 | balance |
| 9 | | 7.1 | 1.9 | 1.2 | 0.12 | 0.06 | 0.13 | 0.05 | 0.04 | 0.06 | 0.007 | — | 0.0005 | 0.0007 | balance |

TABLE 2

Technological properties of experimental alloys

| Alloy | Flowability, mm | Technological plasticity, % upon upsetting on a press | upon tensile |
|---|---|---|---|
| 1 Prior Art | 270 | 70 | 85 |
| 2 | 360 | 89 | 135 |
| 3 | 370 | 94 | 140 |
| 4 | 370 | 97 | 138 |
| 5 | 380 | 95 | 135 |
| 6 | 365 | 87 | 133 |
| 7 | 375 | 95 | 145 |

TABLE 3

Properties of hand forgings with 150 mm thickness in central zone (1/2t)

| Alloy | UTS, MPa L | UTS, MPa ST | YTS, MPa L | YTS, MPa ST | $K_{1c}$ MPa $\sqrt{m}$ L–T | $K_{1c}$ MPa $\sqrt{m}$ S–L |
|---|---|---|---|---|---|---|
| 1 Prior Art | 490 | 467 | 420 | 405 | 31,5 | 26,2 |
| 2 | 528 | 515 | 485 | 477 | 45,3 | 31,5 |
| 3 | 520 | 510 | 483 | 470 | 47,5 | 33,0 |
| 4 | 495 | 490 | 448 | 442 | 50,1 | 34,5 |
| 5 | 505 | 490 | 450 | 440 | 47,7 | 34,3 |
| 6 | 508 | 491 | 451 | 443 | 45,6 | 32,9 |
| 7 | 509 | 489 | 455 | 450 | 47,0 | 34,0 |
| 8 | 512 | 493 | 450 | 448 | 46,9 | 32,0 |
| 9 | 502 | 495 | 455 | 450 | 47,5 | 34,5 |

TABLE 4

Mechanical properties of semiproducts with different thicknesses made of experimental alloys

| Alloy | Semi-product | Thickness (t), mm | YTS(L), MPa ¼ t | YTS(L), MPa ½ t | $K_{1C}$(L-T), MPa $\sqrt{m}$ ¼ t | $K_{1C}$(L-T), MPa $\sqrt{m}$ ½ t | YTS(ST), MPa ¼ t | YTS(ST), MPa ½ t | $K_{1C}$(S-L), MPa $\sqrt{m}$ ½ t |
|---|---|---|---|---|---|---|---|---|---|
| Prior Art | Hand Forging | 60 | 470 | 468 | — | 37.1 | — | 445 | 30.1 |
| | | 100 | 465 | 455 | 37.2 | 34.2 | 440 | 438 | 29.3 |
| | | 150 | 440 | 430 | 35.0 | 31.5 | 425 | 400 | 26.2 |
| | | 200 | 435 | 416 | 32.1 | 28.3 | 410 | 390 | 23.0 |
| | Extrusion | 60 | 470 | 468 | — | 36.3 | — | 461 | 32.1 |
| | | 130 | 455 | 430 | 35.7 | 33.1 | 440 | 415 | 30.8 |
| Suggested composition (No 5) | Hand Forging | 60 | 471 | 468 | — | 51.0 | — | 465 | 35.0 |
| | | 100 | 465 | 462 | 49.6 | 49.1 | 460 | 455 | 34.8 |
| | | 150 | 455 | 450 | 48.3 | 47.7 | 445 | 445 | 34.3 |
| | | 200 | 450 | 445 | 46.5 | 46.0 | 445 | 435 | 34.0 |
| | Extrusion | 60 | 487 | 485 | — | 50.0 | — | 479 | 36.7 |
| | | 130 | 485 | 485 | 45 | 48.0 | 483 | 480 | 36.0 |

TABLE 2-continued

Technological properties of experimental alloys

| Alloy | Flowability, mm | Technological plasticity, % upon upsetting on a press | upon tensile |
|---|---|---|---|
| 8 | 360 | 88 | 135 |
| 9 | 385 | 95 | 143 |

We claim:

1. High strength alloy of aluminum-zinc-magnesium-copper system comprising the following components (in mass. %):

| | | | |
|---|---|---|---|
| Zn | 6.35–8.0 | Si | 0.01–0.2 |
| Mg | 0.5–2.5 | Fe | 0.06–0.25 |
| Cu | 0.8–1.3 | Zr | 0.07–0.2 |

-continued

| | | | |
|---|---|---|---|
| Cr | 0.001–0.05 | Ti | 0.03–0.1 |
| Mn | 0.001–0.1 | Be | 0.0001–0.05 |

and at least one element selected from the group consisting of:

| | |
|---|---|
| K | 0.0001–0.01, |
| Na | 0.0001–0.01 and |
| Ca | 0.0001–0.01; and |
| Al-balance. | |

2. High strength aluminum-based alloy of claim 1, wherein the sum Zr+2Ti≦0.3%.

3. High strength aluminum-based alloy of claim 1, wherein the ratio Si:Be≧2.

4. An article made of a high strength aluminum-based alloy said
alloy comprising the following components (mass. %)

| | | | |
|---|---|---|---|
| Zn | 6.35–8.0 | Si | 0.01–0.2 |
| Mg | 0.5–2.5 | Fe | 0.06–0.25 |
| Cu | 0.8–1.3 | Zr | 0.07–0.2 |
| Cr | 0.001–0.05 | Ti | 0.03–0.1 |
| Mn | 0.001–0.1 | Be | 0.0001–0.05 |

and at least one element selected from the group consisting of:

| | |
|---|---|
| K | 0.0001–0.01, |
| Na | 0.0001–0.01 and |
| Ca | 0.0001–0.01; and |
| Al-balance. | |

5. The alloy of claim 1, wherein the alloy consists essentially of said components.

6. The alloy of claim 1, wherein the alloy consists of said components.

7. The alloy of claim 3, wherein the alloy consists essentially of said components.

8. The alloy of claim 3, wherein the alloy consists of said components.

9. The article of claim 4, wherein the alloy consists essentially of said components.

10. The article of claim 4, wherein the alloy consists of said components.

11. The alloy of claim 1, wherein the at least one element is K or Na.

12. The alloy of claim 1, wherein the at least one element is Ca.

13. The article of claim 4, wherein the at least one element is K or Na.

14. The article of claim 4, wherein the at least one element is Ca.

* * * * *